US008197562B2

(12) United States Patent
Varadaraj et al.

(10) Patent No.: US 8,197,562 B2
(45) Date of Patent: Jun. 12, 2012

(54) MODIFICATION OF RHEOLOGICAL PROPERTIES OF COAL FOR SLURRY FEED GASIFICATION

(75) Inventors: Ramesh Varadaraj, Flemington, NJ (US); Michael Siskin, Westfield, NJ (US)

(73) Assignee: ExxonMobil Research and Engineering Company, Annadale, NJ (US)

( * ) Notice: Subject to any disclaimer, the term of this patent is extended or adjusted under 35 U.S.C. 154(b) by 358 days.

(21) Appl. No.: 12/586,831

(22) Filed: Sep. 29, 2009

(65) Prior Publication Data

US 2010/0083574 A1 Apr. 8, 2010

Related U.S. Application Data

(60) Provisional application No. 61/195,178, filed on Oct. 3, 2008.

(51) Int. Cl.
*C10L 1/04* (2006.01)
*C10J 3/46* (2006.01)

(52) U.S. Cl. ..... 44/624; 44/620; 208/308; 208/309; 208/310 R

(58) Field of Classification Search ..... 44/624, 44/620; 208/308, 309, 310 R
See application file for complete search history.

(56) References Cited

U.S. PATENT DOCUMENTS

| | | | | |
|---|---|---|---|---|
| 4,153,427 | A | 5/1979 | Bissett et al. | |
| 4,191,639 | A * | 3/1980 | Audeh et al. | 208/309 |
| 4,430,193 | A | 2/1984 | Stadelhofer et al. | |
| 4,610,695 | A | 9/1986 | Crespin et al. | |
| 6,117,305 | A | 9/2000 | Bando et al. | |
| 6,211,252 | B1 | 4/2001 | Varadaraj et al. | |
| 6,409,912 | B1 | 6/2002 | Wallace et al. | |
| 6,444,711 | B2 | 9/2002 | Varadaraj et al. | |
| 7,759,415 | B2 * | 7/2010 | Coffey et al. | 523/351 |
| 2008/0221378 | A1 | 9/2008 | Stell et al. | |
| 2010/0243248 | A1 * | 9/2010 | Golomb et al. | 166/270 |

FOREIGN PATENT DOCUMENTS

| | | |
|---|---|---|
| GB | 902659 | 8/1962 |
| WO | WO 2007/042564 A1 | 4/2007 |

OTHER PUBLICATIONS

Bentley et al., "Novel Analgesics and Molecular Rearrangments in the Morphine-Thebaine . . . ", Journal of the American Chemical Society, 89(13), 1976, pp. 3267-3273.
William Donohue; J. David Bourke; "Factors Affecting Pump Selection for Slurry-Type Fuels," MOYONO, pp. 1-11, 1965.
J. H. Pacheco-Sanchez; F. Alvarez-Ramirez; J. M. Martinez-Magadan; "Morphology of Aggregated Asphaltene Structural Models," Energy & Fuelsl, 2004, 18, pp. 1676-1686.

* cited by examiner

*Primary Examiner* — James Goloboy
*Assistant Examiner* — Chantel Graham
(74) *Attorney, Agent, or Firm* — Bruce M. Bordelon

(57) ABSTRACT

The feeding of coal slurries into a gasifier for the production of synthesis gas is improved by modifying the rheological properties of the coal particles so that conventional liquid transfer equipment can be used in the feed transfer process to the gasifier. The coal particle surface modification is accomplished by adsorbing asphaltenes derived from petroleum onto the surfaces of coal particles prior to and/or during contact with the slurry liquid. The coal particles with their surfaces thus modified exhibit lower particle-particle interaction in the liquid slurries to form a shear independent Newtonian fluid or a weakly shear thickening pseudoplastic fluid. The rheological properties of the slurries permit them to be transported reliably into a pressurized, entrained feed gasifier vessel using convention slurry pumps with a low potential expenditure of energy.

10 Claims, 3 Drawing Sheets

| % Pocahontus Coal | % C5 DAU Rock | % LCCO Oil |
|---|---|---|
| 64 | 0 | 36 |
| 63 | 1 | 36 |
| 62 | 2 | 36 |
| 60 | 4 | 36 |

MODIFICATION OF RHEOLOGICAL PROPERTIES OF COAL FOR SLURRY FEED GASIFICATION

This application claims the benefit of U.S. Provisional Application No. 61/195,178 filed Oct. 3, 2008.

FIELD OF THE INVENTION

The present invention relates to entrained flow coal gasification using a slurry feed and more particularly to a process for modifying the rheological properties of coal to render it amenable to from slurries which can be pumped and handled more easily.

BACKGROUND OF THE INVENTION

With increased use and decreasing availability of petroleum supplies, coal gasification is currently becoming more attractive technically and economically as a versatile and clean way to convert the energy content of coal into electricity, hydrogen, and other high quality transportation fuels, as well as into high-value chemicals to meet specific market needs. Most importantly, in a time of unpredictable variations in the prices of electricity and fuels, gasification systems can provide a capability to operate on low-cost, widely-available coal reserves. Gasification may be one of the best ways to produce clean liquid fuels and chemical intermediates from coal as well as clean-burning hydrogen which also can be used to fuel power-generating turbines or used in the manufacture of a wide range of commercial products.

Four basic types of gasifiers are currently available for commercial use: counter-current bed, co-current bed, fluidized bed and entrained flow. In the counter-current fixed bed ("up draft") gasifier the gasification agent (steam, oxygen and/or air) flows in counter-current configuration through a descending bed of the carbon-containing fuel with the ash removed dry or as a slag. The co-current bed gasifier is similar to the counter-current type, but the gasification agent gas flows downwards in the same direction as the fuel. In the fluidized bed reactor, the fuel is fluidized in the gasification agent. In the entrained flow gasifier a dry pulverized solid, an atomized liquid fuel or a fuel slurry is gasified with oxygen or air in co-current flow and the gasification reactions take place in a dense cloud of very fine particles. Most coals are suitable for this type of gasifier because of the high operating temperatures and the good contact achieved between the coal particles and the gasifying agent.

Cost effective and reliable delivery of coal or any hydrocarbonaceous feedstock to a high pressure gasifier entrained feed reactor is a key process in the overall scheme of gasification. There are primarily three feedstock delivery options for high pressure coal gasifier entrained feed reactors:

1) coal/water slurry
2) coal solids with a carrier gas such as nitrogen or carbon dioxide, and
3) coal/non-aqueous liquid slurry.

The first two options are widely practiced in commercial operation. The coal/water slurry delivery, though low in cost and reliable, suffers from the disadvantage that it results in low gasification efficiency. The viscosities of the coal/water slurries are also subject to shear rate sensitivity of slurry and there are drawbacks also resulting from the reduction in coal throughput and the handling of sooty water. Alternatively, the coal solids with carrier gas delivery systems result in high gasification efficiency but require expensive lock hoppers and valve systems for safe operation. Lastly, the coal/non-aqueous liquid slurry delivery option has the advantages of an ability to use low cost, high reliability slurry pumps as well as the ability to obtain high gasification efficiencies. However, this last feed option has the drawback of a limited commercial availability of conventionally suitable oils for forming the slurry. An additional source of problems with the present coal/non-aqueous liquid slurry delivery systems is that the rheological properties of the conventional coal-oil slurries, similar to the coal/water slurries, exhibit viscosity sensitivity to shear rate. In general terms, the conventional coal/oil slurries behave as Bingham fluids for which the imposed stress must exceed a critical yield stress to initiate motion. This results in difficulties in pumping and handling in general since behavior as a Newtonian fluid cannot be assumed.

While approaches towards dealing the handling problems with coal/water slurries have been proposed, e.g. in U.S. Pat. No. 6,444,711, the related problems of coal/oil slurries have so far not been adequately addressed.

SUMMARY OF THE INVENTION

It has been discovered herein that the rheological properties of coal can be successfully modified so that conventional pump equipment can be used with slurries of the modified coal in oil or liquid carbon dioxide. The fluid property problems with the coal/non-aqueous slurries of the prior art are solved through the coal particle surface modification of the present invention. Herein, the coal particle surface modification is accomplished by adsorbing asphaltenes derived from petroleum onto the surfaces of the comminuted coal particles prior to or during contact with the slurry liquid. The coal particles with their surfaces thus modified exhibit lower particle-particle interaction in the liquid slurries. This decrease in particle-particle interaction results in an alteration of the rheological properties of the slurry which alters from a shear-thinning Bingham plastic fluid to a shear independent Newtonian fluid or a weakly shear thickening pseudoplastic fluid. The rheological properties of the slurries permit them to be transported reliably into a pressurized, entrained feed gasifier vessel using convention slurry pumps with a low potential expenditure of energy.

According to the present invention, therefore, the surface properties of coal particles are modified by contacting the particles with petroleum asphaltenes prior to forming the particles into a slurry with an oil or liquid carbon dioxide. The slurries formed in this way may then be fed to a high pressure gasifier.

DETAILED DESCRIPTION OF THE INVENTION

Figure 1:
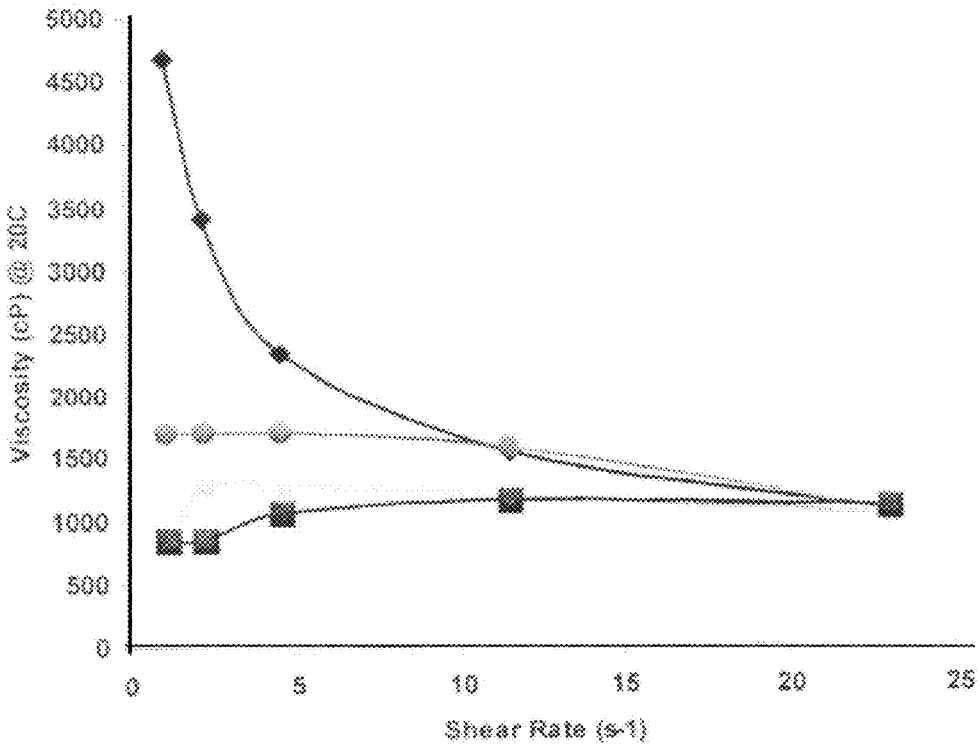
FIG. 1 is a graph illustrating the viscosity versus shear rate profile for a bituminous coal slurry from the Example herein.

The surface modification of the coal particles which are to be taken up into the slurry is accomplished by adsorbing crude oil asphaltenes onto the surfaces of comminuted coal particles prior to and/or during contact with the slurry liquid. The coal particles with their surfaces thus modified exhibit lower particle-particle interaction in the liquid slurry; this decrease in particle-particle interaction, which changes the slurry from a dilatant (shear thinning) fluid to a shear independent Newtonian fluid or a weakly shear thickening pseudoplastic fluid. The slurries made from these surface-modified coals can therefore be pumped more predictably and handled with conventional fluid handling equipment.

Asphaltenes are molecular substances that are found in crude oil as well as coal tars and can be separated from them by certain extractive processes; they consist primarily of carbon, hydrogen, nitrogen, oxygen, and sulfur, as well as trace amounts of vanadium and nickel and have a relatively high carbon:hydrogen ratio, typically over 1. The proportion of asphaltenes in oils generally increases with increasing boiling range of the fraction and in fractions boiling above 450° C., such asphaltenes may be present to a significant amount. As implied by their name, asphaltenes are to be found in the asphalt fraction of a crude oil or petroleum resid (atmospheric or vacuum); this fraction is soluble in aromatic hydrocarbons, carbon disulfide and chlorinated hydrocarbons but insoluble in aliphatic hydrocarbons, especially the light paraffins which are used commercially in the refinery for removing the asphalt from high boiling fractions, for example, in the production of lubricating oils. The most common paraffins used to precipitate asphalts from residual fractions are propane and n-pentane although butane, hexane and heptane and light naphthas, preferably 86-88° Beaumé, are also effective for this purpose. A common solvent used for characterization purposes is precipitation naphtha whose composition is defined in test method ASTM D91. The asphaltic fraction itself comprises a number of different materials with different solubility characteristics, including the light alkane insoluble fraction, referred to the asphaltene fraction and the light alkane soluble fraction commonly known as maltenes or petrolenes which can itself be resolved into further fractions including a resin which can be separated by percolation over alumina or by precipitation with propane. The equivalent terms "aphaltenes" or "petroleum asphaltenes" as utilized herein are defined as the heptane insoluble asphaltenes present in a hydrocarbon-containing stream as per standard test method ASTM D6560.

The asphaltenes can be used in the form recovered from petroleum refining operations, typically as the residue from a deasphalting process, for example, a propane deasphalting step used in lube oil manufacture but normally they will require blending with an oil in order to distribute the asphaltene over the coal particles. The asphaltenes are preferably taken up in the slurrying oil but could be dissolved in a lighter solvent oil prior to mixing with the slurrying oil.

A suitable source of asphaltenic material for treating the coal particles is deasphalter unit rock ("DAU Rock"), which is the solid (at atmospheric temperatures and pressures), highly carbonaceous asphaltic residue obtained from a deasphalting unit, e.g. a propane deasphalter. Other sources of asphaltenes are the extracts from high boiling crude oil fractions (residual fractions) which are insoluble in n-heptane; the heptane-soluble fraction comprises the maltene or petrolene fraction which can itself be resolved into further fractions including a resin which can be separated by percolation over alumina or by precipitation with propane. The attractiveness of the DAU Rock as an asphaltene source is that it is not readily amenable to further refining and for this reason, the present invention provides a useful means of disposal for the DAU Rock.

The oil used for slurrying the coal particles conventionally comprises a light catalytic cycle oil (LCCO) but other fractions, typically of limited value in themselves may also be used. Such fractions are typically high boiling fractions (400° C.+), normally residual fractions which cannot be distilled under normal vacuum distillation conditions. Fractions of this type will normally have an initial boiling point of at least 500° C. or more, e.g. 540° or 550° C. These high boiling fractions generally contain significant proportions of aromatics which favors their ability to dissolve the asphaltenes and for this reason, the highly aromatic, dealkylated fractions such as the cycle oils from catalytic cracking processes are favored. Cycle oils from the catalytic cracking process (herein termed "catalytic cracking cycle oils") are normally highly aromatic fractions, preferably with an aromatics content of at least 50 wt. percent, more preferably at least 75 wt. percent based on the cycle oil stream. Preferably, these cycle oils have an API gravity of less than 25, preferably less than 15, and even more preferably less than 10. Full range cycle oil, heavy cycle oil and light cycle oil are all considered as catalytic cracking cycle oils and may used for slurrying the coal particles. A light cycle oil boiling approximately in the range of 205° to 400° C. (about 400° to 700° F.) is suitable, such as the following oil composition shown in Table 1:

TABLE 1

| | |
|---|---|
| Gravity, ° API, ASTM D 287 | 17.6 |
| Distillation, ASTM D 86, ° C. | |
| Initial Point | 181 |
| 10% condensed | 222 |
| 30 | 234 |
| 50 | 242 |
| 70 | 251 |
| 90 | 266 |
| End Point | 303 |
| Sulfur, ppm | 9,800 |
| Nitrogen, ppm | 109 |
| Hydrocarbon Type, Vol. % | |
| Aromatics | 88.5 |
| Olefins | 1.2 |
| Saturates | 10.3 |

The asphaltene material may be dissolved in a lighter fraction such as heavy gasoline, heavy naphtha, diesel oil (e.g. Diesel No. 2 or Diesel No. 4), or mixtures thereof to form a solution which is then sprayed or otherwise applied to the coal particles to achieve the desired surface modification. Another alternative would be to dissolve the asphaltene material in a small volume of the solvent oil and then to blend this into an emulsion with a larger volume of water which is then applied to the coal.

The amount of asphaltene relative to the coal (solids) should be selected in relation to the average particle size of the coal since the particle size is related to the total surface area to be treated. However, as a general guide, the amount of asphaltene utilized in the current process should be from about 0.1 to about 25 weight percent of the coal, more preferably from about 0.5 to about 15 weight percent of the coal, and even more preferably from about 1.0 to 10 weight percent of the coal.

The coal may be of any rank suitable for gasification and this may be lignite, sub-bituminous, bituminous or even anthracite. To form a slurry in the selected oil it preferred if the average diameter (by weight of the overall particles) the coal particles is from about 0.05 to about 10 mm, and even more preferably, the average diameter the coal particles is from about 0.10 to about 5 mm. Conventional slurrying techniques and equipment can be applied.

Liquid carbon dioxide ($CO_2$) may be as an alternative to oil as the slurry liquid with similar results. At high solids-toliquid $CO_2$ ratio (typically at the 96:4 wt/wt ratio used in commercial operations), the effect of coal particle-coal particle interaction is high. Reduction in coal particle-coal particle interaction is expected to lead to lower viscosity and reduced shear thinning. In the case of use with liquid $CO_2$, the coal surface should be asphaltene modified in the first step. Here, the coal can first be contacted with an asphaltene solution in a light aromatic solvent, the solvent stripped off and recycled. The surface modified coal can then be slurried with liquid $CO_2$ to provide the modified slurry for delivery to the gasifier.

EXAMPLE

The effect of the asphaltene modification of the present invention was experimentally demonstrated using bituminous (Pocahontas), sub-bituminous (Wyodak and Blind Canyon) and lignite (Buelah-Zap) coals. A light catalytic cycle oil (LCCO) boiling in the temperature range of 180 to 300° C. was used as the non-aqueous slurry liquid. Deasphalter unit rock ("DAU Rock") obtained from a refinery pentane deasphalter, and n-heptane insoluble extracts from Talco and Tulare crude oils were used as the asphaltenes for adsorption onto the coal surfaces.

In a typical experiment the LCCO slurry liquid was first pipetted out into a container. To the slurry liquid was added asphaltene solids (DAU Rock or asphaltene extracted from crude oil) followed by addition of the selected coal and mixing with a spatula. The viscosity of the prepared coal-oil slurry was determined as a function of shear rate at 20° C. A Brookfield viscometer used with a vane 75 spindle (the industry recommended spindle for measurement of slurry viscosities).

FIG. 1 shows the viscosity versus shear rate profile for a slurry composed of Pocahontas bituminous coal, DAU Rock and LCCO. As can be observed the slurry is a strongly shear thinning fluid in the absence of DAU Rock. With addition of increasing amounts of DAU Rock the profile changes from shear thinning to shear independent to weakly shear thickening.

Figure 2:
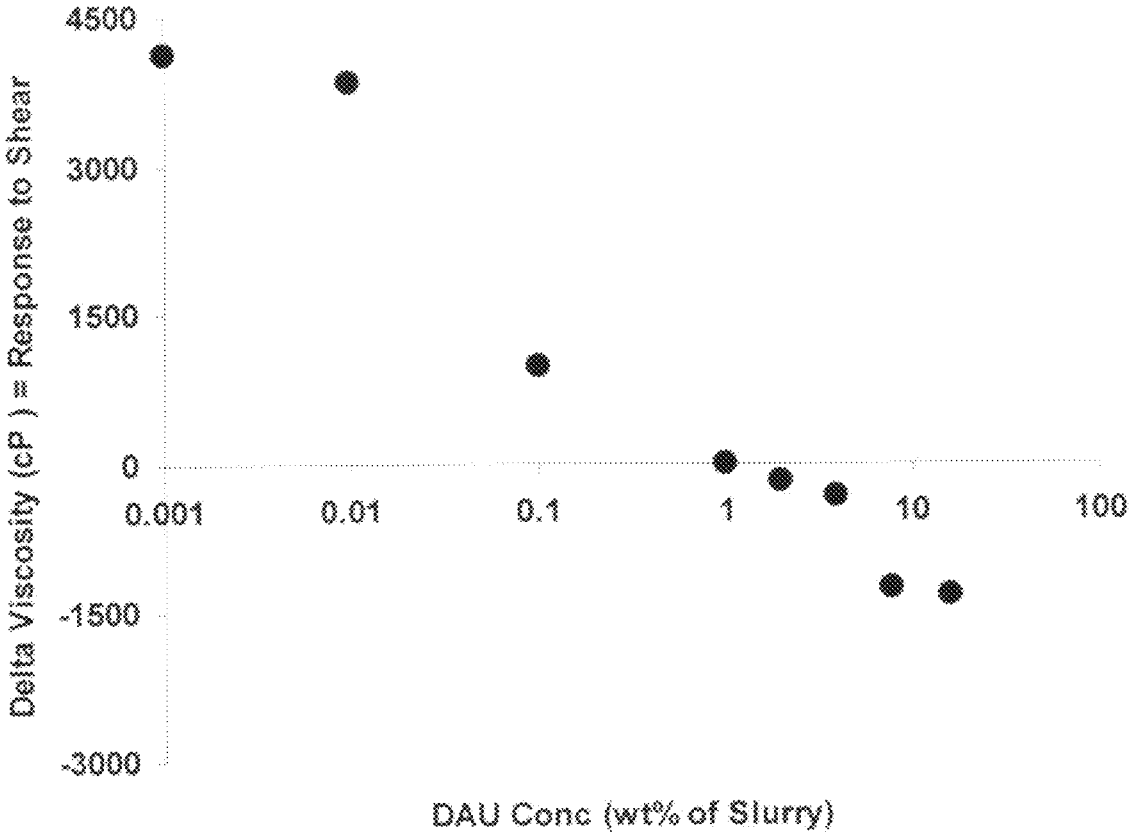
FIG. 2 is a graph showing the asphaltene concentration for the same bituminous coal system as in FIG. 1 as a function of the difference in viscosity at two shear rates from the Example herein.

FIG. 2 is a plot of DAU rock concentration for the same system (Pocahontas/DAU Rock/LCCO) as a function of the difference in viscosity at 1 $sec^{-1}$ and 22 $sec^{-1}$. The difference is denoted as "Delta Viscosity" and represents the shear response of the fluid. Positive Delta Viscosity values represents shear thinning, zero value represents shear independence and negative values represent shear thickening. Adsorption of DAU Rock on coal surface is inferred from the observation of concentration dependence of the shear response effect.

Figure 3:
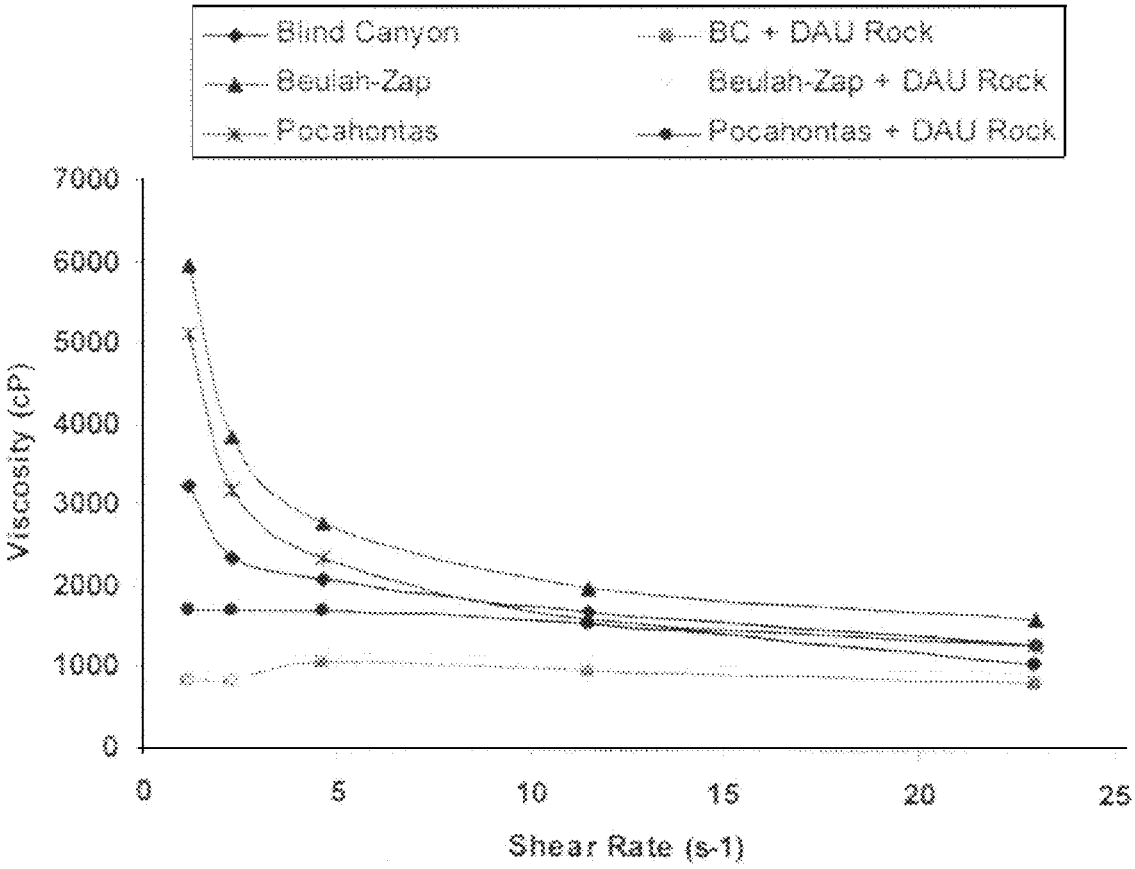
FIG. 3 is a graph showing the viscosity versus shear rate profile for three coals of varying rank from the Example herein.

FIG. 3 presents results for the three coals of varying rank i.e., bituminous (Pocahontas), sub-bituminous (Blind Canyon) and lignite (Beulah-Zap). As can be observed the effect is broadly applicable over the range of coals.

Scanning electron microscope micrograph was obtained for Pocahontas coal with and without the DAU rock treatment. Prior to treatment with DAU Rock the coal surface reveals porous character. After treatment with DAU Rock the surface exhibits a smooth texture. Energy Dispersive Spectroscopy (EDS) of the surface showed the treated coal had a higher concentration of S, V and Ni consistent with the adsorption of DAU Rock asphaltenes.

What is claimed is:

1. In a method of forming a slurry feed for a gasifier by forming coal particles into a slurry with a slurrying liquid selected from liquid petroleum fractions and liquid carbon dioxide, the improvement which comprises modifying the rheological properties of the coal particles to improve their ability to the formation of slurries in the slurrying liquid by contacting the particles with a solution in a liquid petroleum fraction of petroleum asphaltenes to adsorb the asphaltenes onto the surfaces of coal particles prior to or during contact with the slurrying liquid.

2. The method according to claim 1, wherein the petroleum asphaltenes comprise a solid (at atmospheric temperature and pressure), highly carbonaceous, n-heptane insoluble, asphaltic residue obtained from a de-asphalting unit.

3. The method according to claim 1, wherein the slurrying liquid comprises catalytic cracking cycle oil.

4. The method according to claim 1, wherein the petroleum asphaltenes are dissolved in the same liquid as the slurrying liquid.

5. In a method of making synthesis gas by the gasification of coal in a gasifier using a slurry feed of comminuted coal particles in a slurrying liquid selected from liquid petroleum fractions and liquid carbon dioxide, the improvement which comprises modifying the rheological properties of the comminuted coal particles to improve their amenability to the formation of slurries in the slurrying liquid by contacting the particles with a solution in a liquid petroleum fraction of petroleum asphaltenes to adsorb the asphaltenes onto the surfaces of coal particles prior to or during contact with the slurrying liquid.

6. The method according to claim 5, wherein the petroleum asphaltenes comprise a solid (at atmospheric temperature and pressure), highly carbonaceous, n-heptane insoluble, asphaltic residue obtained from a de-asphalting unit.

7. The method according to claim 5, wherein the slurrying liquid comprises catalytic cracking cycle oil.

8. The method according to claim 5, wherein the petroleum asphaltenes are dissolved in the same liquid as the slurrying liquid.

9. The method according to claim 5, wherein the amount of petroleum asphaltenes utilized in the process are from about 0.1 to about 25 weight percent of the coal particles.

10. The method according to claim 5, wherein the average diameter (by weight) of the coal particles is from about 0.05 to about 10 millimeters.

* * * * *